US005921250A

United States Patent [19]

Rhea et al.

[11] Patent Number: 5,921,250

[45] Date of Patent: Jul. 13, 1999

[54] ARTIFICIAL NAIL REMOVER CONTAINER DEVICE AND METHOD

[76] Inventors: Cord L. Rhea; Kelly D. Rhea, both of 6212 Bayswater, Amarillo, Tex. 79109

[21] Appl. No.: 09/196,757

[22] Filed: Nov. 20, 1998

[51] Int. Cl.[6] ..... A45D 29/18; A45D 29/00; A61H 21/00

[52] U.S. Cl. ..... 132/74.5; 132/73.5; 132/73; 607/86

[58] Field of Search ..... 132/74.5, 73.5, 132/75; 607/85, 86, 87, 97, 104, 108

[56] References Cited

U.S. PATENT DOCUMENTS

| | | | |
|---|---|---|---|
| 100,863 | 3/1870 | Corbett . | |
| 213,029 | 3/1879 | Ashcroft . | |
| 2,703,422 | 3/1955 | Roosa . | |
| 2,904,037 | 9/1959 | Cassidy | 128/66 |
| 3,055,357 | 9/1962 | Redka | 128/32 |
| 3,641,992 | 2/1972 | Peyser et al. . | |
| 4,180,884 | 1/1980 | Hess et al. . | |
| 4,474,195 | 10/1984 | Warner | 132/73 |
| 4,964,372 | 10/1990 | Zeenni et al. | 132/740 |
| 5,139,036 | 8/1992 | Pickard | 132/73.5 |
| 5,388,597 | 2/1995 | Smith et al. . | |
| 5,582,333 | 12/1996 | Bennett . | |
| 5,769,099 | 6/1998 | Davis et al. . | |
| 5,823,203 | 10/1998 | Carroll et al. | 132/200 |

*Primary Examiner*—John J. Wilson
*Assistant Examiner*—Trang Docin
*Attorney, Agent, or Firm*—Richard C. Litman

[57] ABSTRACT

An artificial nail remover container device and method comprising an inner chamber containing hot water for heating solvent in at least one outer chamber or basin. The bottom of the outer chamber can have ridges and/or marbles. The inner chamber can have a vibrator motor driven by a rechargeable battery for agitating the solvent for removal of artificial nails from fingernails.

16 Claims, 5 Drawing Sheets

ARTIFICIAL NAIL REMOVER CONTAINER DEVICE AND METHOD

BACKGROUND OF THE INVENTION

1. Field of the Invention

The present invention relates to an artificial nail remover method and container device containing a solvent and a heating solution in separate compartments.

2. Description of the Related Art

The relevant art of interest describes various nail polish and artificial nail removing containers as well as double boiler cooking ovens. An economical artificial nail remover container device and method for removing artificial nails from one or both hands has not been shown. The problem of removing adhered artificial nails from fingernails involves a prolonged period of immersion in a volatile odoriferous solvent. The long exposure problem has been solved by the addition of a separate compartment for hot water for heating the solvent in a separate compartment. Agitation of the solvent aids in reducing the adhesive dissolving process period. The addition of ridges and/or marbles on the bottom of the solvent containing basin further enhances the removal process.

The relevant art will be discussed in the order of perceived relevance to the present invention.

U.S. Pat. No. 5,388,597 issued on Feb. 14, 1995, to Clifford W. Smith describes an artificial fingernail remover and brush cleaner device. A cylindrical container of acetone has a lower housing and an upper housing with a dumbbell shaped aperture, but with unequal sized apertures. A door handle with a spring bias is located in the smaller aperture. A finger is dipped from the larger aperture for removal of an artificial fingernail. A brush with a handle is trapped in the larger aperture for cleaning without touching the bottom. The device is distinguishable for its limitation to one finger at a time and the addition of a door and handle.

U.S. Pat. No. 5,582,333 issued on Dec. 10, 1996, to Robert Bennett describes a nail polish remover dispenser containing a liquid solvent. The container cap is made from either polyethylene, polypropylene or polyethylene terephthalate. The cap has a hinged lid and an apertured concave deck for return of excess solvent. The dispenser is distinguishable for its cap with a hinged lid and a concave apertured deck.

U.S. Pat. No. 5,769,099 issued on Jun. 23, 1998, to Aaron L. Davis et al. describes an automated nail polish remover device which supplies a rotating brush with solvent for treating a plurality of fingernails of a hand. The automated device is distinguishable for its mechanical structure requiring a rotating brush.

U.S. Pat. No. 4,180,884 issued on Jan. 1, 1980, to Don Hess et al. describes a fingernail cleaning apparatus comprising a motor driven disc-shaped rotary brush supplied with a soap solution. A guide assembly includes a sealing structure for sealing around the fingers to prevent escape of the cleaning liquid. The apparatus is distinguishable for its mechanical and sealing structure.

U.S. Pat. No. 2,703,422 issued on Mar. 8, 1955, to Vernon D. Roosa describes a device for removing coatings from fingernails a finger at a time. A capped square bottle has a bristle brush anchored by its wired ends at the bottom of the bottle containing a solvent. The device is distinguishable for its requirement for a specifically shaped and anchored brush.

U.S. Pat. No. 3,641,992 issued on Feb. 15, 1972, to Harry A. Peyser et al. describes a circular double-boiler heating container. An outer container body contains water. Seated within the outer container body is an inner container body containing food to be cooked. A lid of the inner container body has its peripheral flange and the outwardly directed flange of the inner container body joined and apertured for escape of the steam into a closure (cover) space and out through a central aperture in the closure. The peripheral edges of the closure, the lid and the flange of the inner container are sealed within a peripheral curl of the inner and outer containers. The double-boiler heating container is distinguishable for its double-boiler structure with an integrated cover.

U.S. Pat. No. 100,863 issued on Mar. 15, 1870, to Cooper E. Corbett describes a culinary vessel comprising an inside kettle for cooking food and an outside boiler vessel. Both vessels have covers with the outer cover having an aperture for escaping steam. The inner vessel has a peripheral flange and ears for interlocking with the slotted and perforated inside rim of the outer boiler. The domestic boiler is distinguishable for its kettle and boiler structure.

U.S. Pat. No. 213,029 issued on Mar. 11, 1879, to John Ashcroft describes a steam cooking stove having an outer jacket and an inner oven. A cover is separated into two portions with a steam reception chamber and a dead air space chamber having an oven lid. The steam enters the cover through an inlet pipe into the steam reception chamber which has perforations for passage of the steam into the steam space between the two vessels. A meat juice trap is connected to the oven. The steam space has an outlet pipe at the bottom of the jacket for collection of water and/or steam by a trap. The steam cooking stove is distinguishable for its integrated cover with separate chambers for steam and dead air.

None of the above inventions and patents, taken either singularly or in combination, is seen to describe the instant invention as claimed. Thus, an economical time-saving artificial nail remover container device and method for treating one or both hands and solving the aforementioned problems is desired.

SUMMARY OF THE INVENTION

A device and method for dissolving the adhesive bonding artificial nails to fingernails for one or both hands in a minimum of time and expense is shown. The present invention comprises a device for heating the solvent in a container surrounded by a hot water bath. The entire hand or hands can be dipped into one or two basins. The solvent bath can be agitated by a sonic vibrator to decrease the immersion time. There is no need for brushes or other implements in this artificial nail removal process.

Accordingly, it is a principal object of the invention to provide a device and method for the removal of artificial nails from fingernails on one or both hands in a warmed solvent bath.

It is another object of the invention to provide a device and method for the removal of artificial nails from fingernails in a warmed solvent bath heated by an integrated heating liquid.

It is a further object of the invention is to provide a device and method for the removal of artificial nails from fingernails in separate warmed solvent baths by dipping the fingers of both hands into separate warmed solvent baths.

Still another object of the invention is to provide a device and method for the removal of artificial nails from fingernails in a warmed solvent bath which is agitated by sonic vibration.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
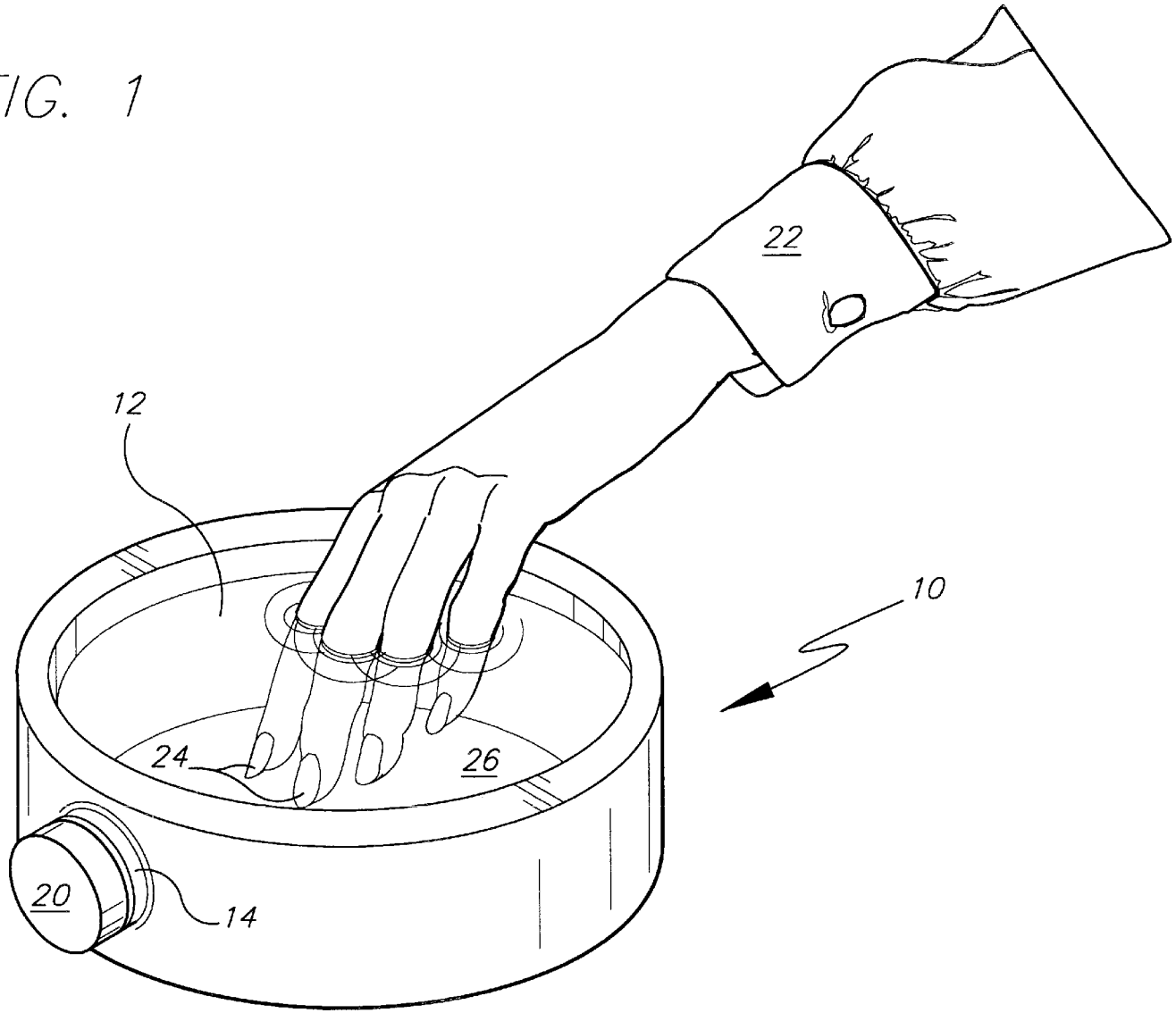
FIG. 1 is an environmental, perspective view of a first embodiment of an artificial nail remover device according to the present invention.

The present invention is directed to an economical device for use in homes or in salons to remove artificial nails bonded by adhesive to one's fingernails. Artificial fingernails are made of acrylic, fiberglass, or ultraviolet radiated gel. In FIG. 1, a plastic bath container device 10 is depicted with warmed solvent 12 such as acetone. The device 10 has a port 14 for filling an inner chamber 16 (FIGS. 3 and 4) with hot water 18 to heat the solvent 12. The port 14 is externally threaded to enable the capping of the port with a threaded cap 20. A woman 22 dips her artificial fingernails 24 into the warmed solvent 12 and scrapes her finger on the bottom 26 to encourage the solvent to penetrate under the artificial nails. Optionally, the bottom 26 can have ridges (not shown) to enhance the scraping effect. Marbles can be used for occupying the woman's attention during the 20 min. soaking period.

Figure 2:
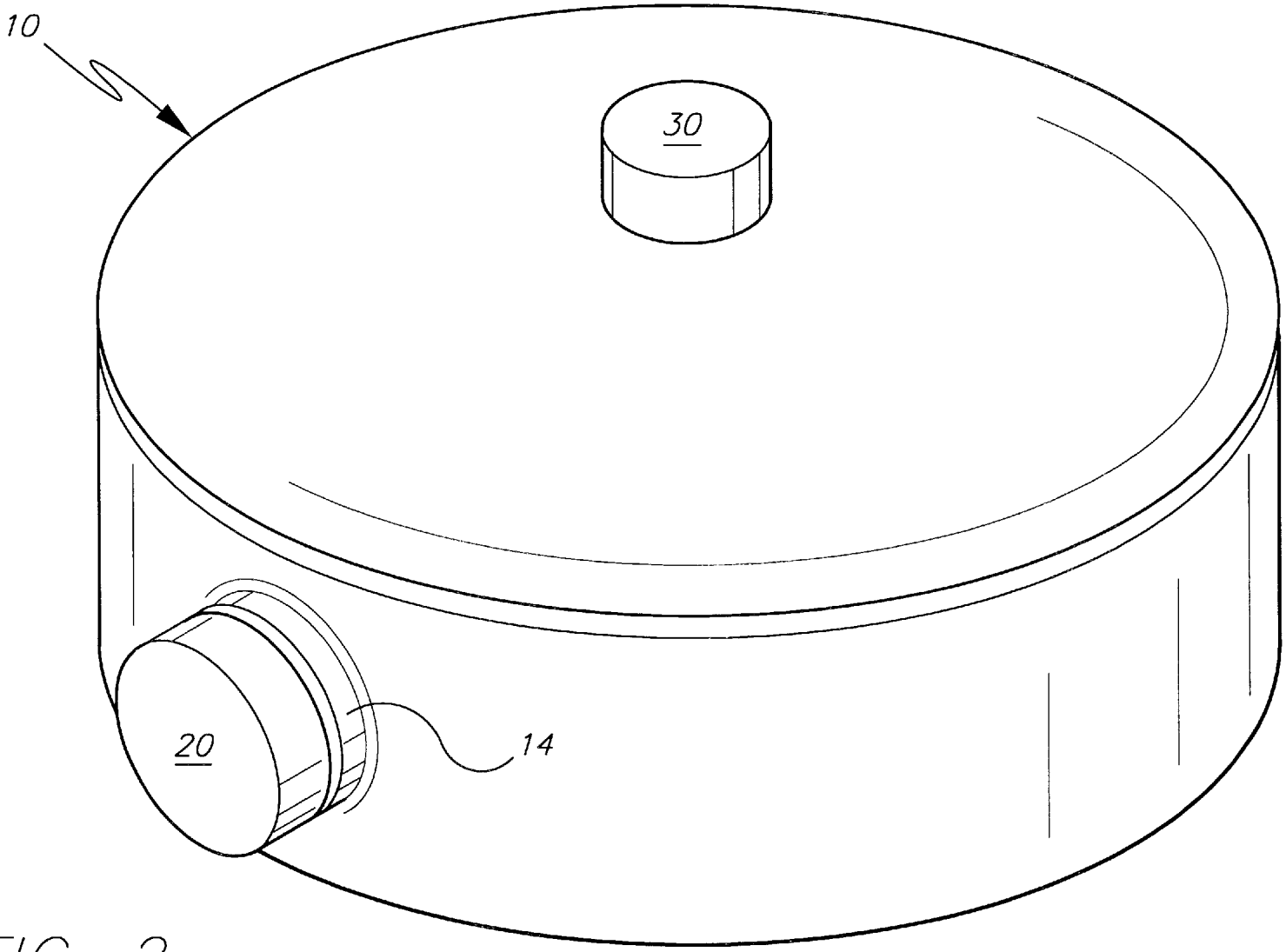
FIG. 2 is a side elevational view the FIG. 1 device.

When the device 10 is not used, a cover 28 with a knob 30 as depicted in FIG. 2 can be utilized to minimize the evaporation of the warmed acetone 12 into the environment. An exemplary size of the device 10 is a circular shape having a diameter of 7 in. and a height of 3 in.

The hot water 18 at 100° F. inside the inner chamber 16 will heat the acetone to 94° F. for treatment of the artificial nails 24. The acetone will cool down to 83° F. in 20 minutes. It has been found beneficial to add a drop of an emollient to the acetone.

Device 10 can be conveniently molded in one piece of plastic material excluding the cap 20 and the cover 28.

Figure 3:
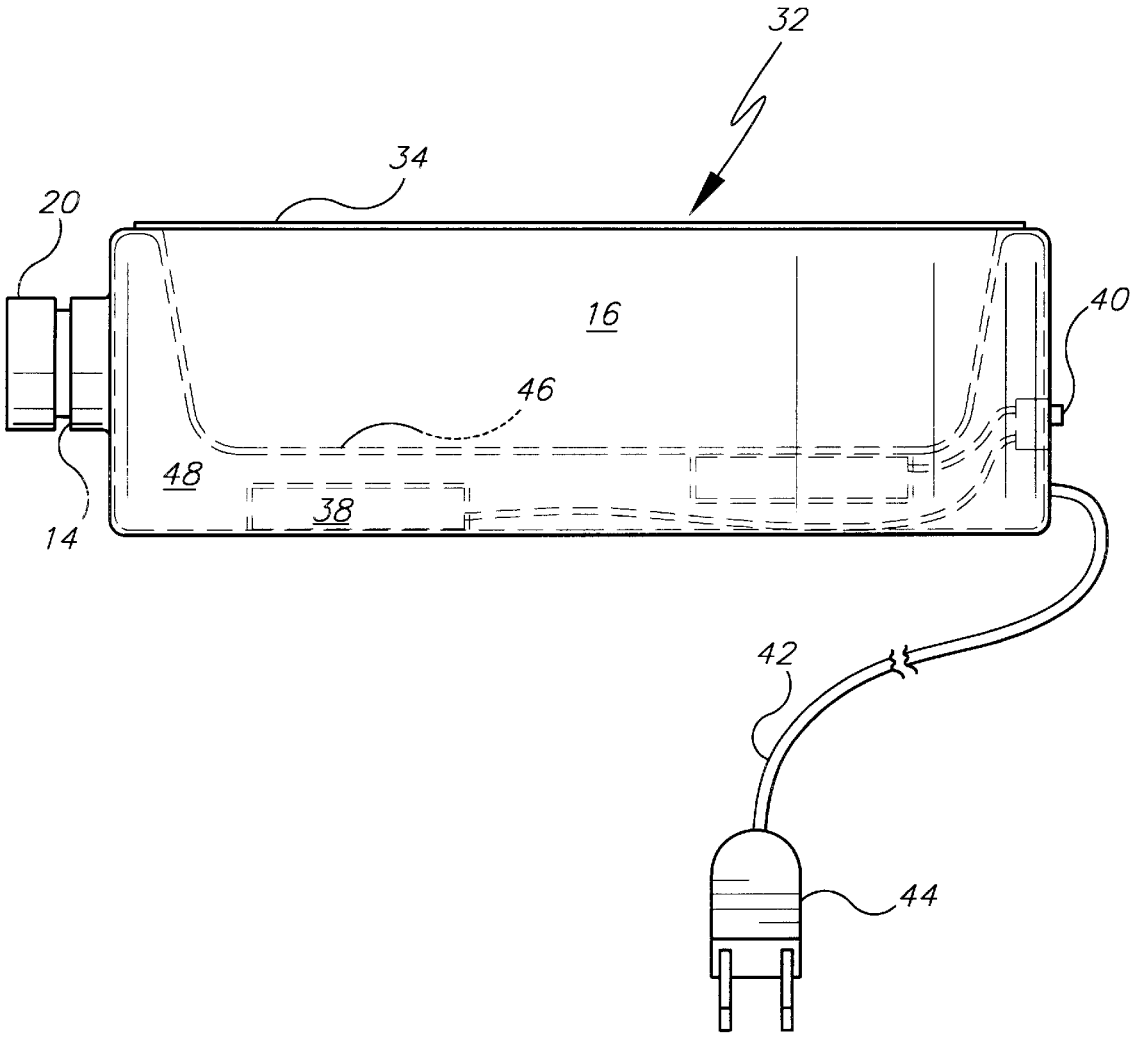
FIG. 3 is an elevational side view of a second embodiment of the present invention adding a vibrator.

A second embodiment of the present invention is shown in FIG. 3, wherein agitation of the solvent bath enhances the artificial fingernail removal process. The agitated bath container device 10 has a cover 34, a sealed vibrator motor 36, a rechargeable battery 38, an on/off switch 40, an electrical cord 42, and a plug 44. The vibrator motor 36 is attached to the bottom 46 of the outer chamber 48 and inside the inner chamber 16. It has been observed that contact of the artificial fingernails 24 with the vibrating surface of the bottom 46 is especially beneficial and improves the immersion in half the time required without the vibration effect.

Figure 4:
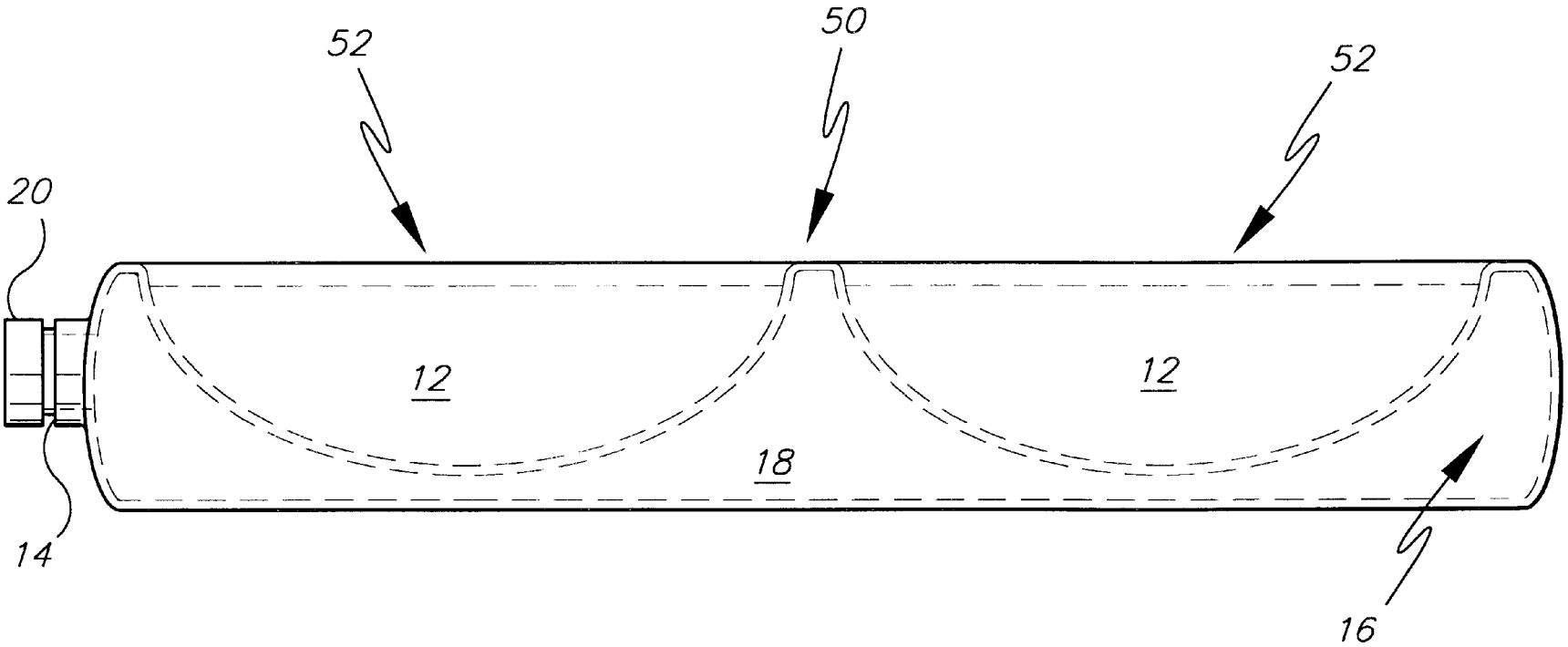
FIG. 4 is an elevational side view of a third embodiment of the present invention having two basins for the treatment of both hands simultaneously.
Figure 5:
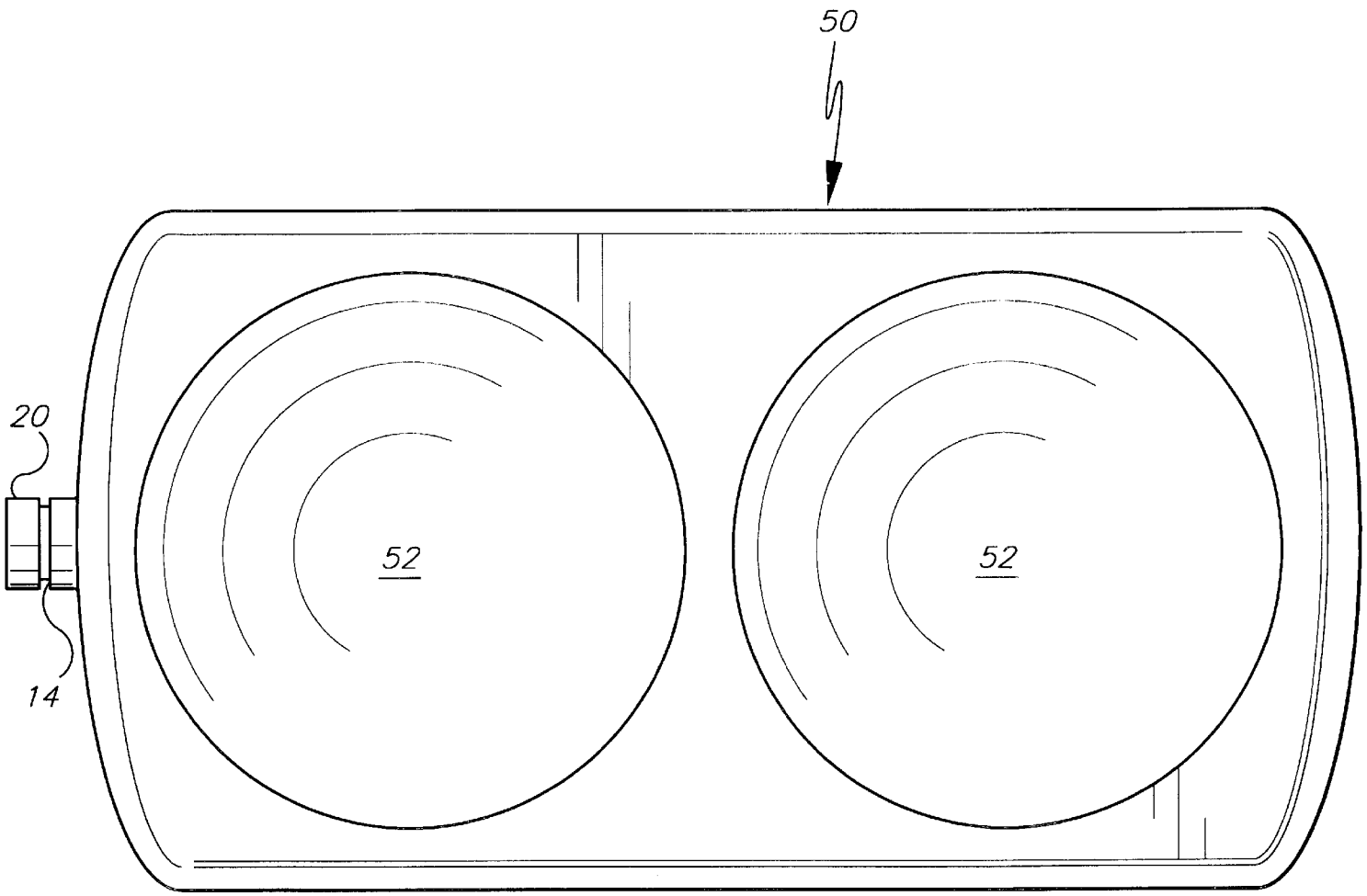
FIG. 5 is a plan view of the third embodiment of FIG. 4.

A third embodiment of the present invention is shown in FIGS. 4 and 5, wherein the double basin device 50 permits the soaking of the artificial fingernails of both hands simultaneously in basins 52.

It is to be understood that the present invention is not limited to the embodiments described above, but encompasses any and all embodiments within the scope of the following claims.

We claim:

1. An artificial nail remover container device comprising:

a plastic bath container containing an upper chamber, a lower chamber and one end;

said upper chamber comprising at least one basin with a curvilinear bottom for accepting a solvent; and said lower chamber having at, said one end, a port and a cap for filling and storing a hot liquid;

whereby the solvent is heated by the hot liquid for dissolving an adhesive attaching the artificial nail to a fingernail.

2. The artificial nail remover container device according to claim 1, wherein said curvilinear bottom of said at least one basin has ridges for aiding the removal of the artificial nail from the fingernail.

3. The artificial nail remover container device according to claim 1, wherein said curvilinear bottom of said at least one basin has marbles for aiding the removal of the artificial nail from the fingernail.

4. The artificial nail remover container device according to claim 1, including two basins for immersing the artificial nails of both hands.

5. The artificial nail remover container device according to claim 1, including a sealed vibrator motor attached underneath the curvilinear bottom of the upper chamber for vibrating the solvent.

6. The artificial nail remover container device according to claim 5, including a sealed rechargeable battery in the lower chamber for energizing the sealed vibrator motor.

7. The artificial nail remover container device according to claim 6, including an electrical cord and plug for energizing the sealed vibrator motor.

8. The artificial nail remover container device according to claim 5, including an on/off switch on the outside of the device for activating the sealed vibrator motor.

9. The artificial nail remover container device according to claim 1, including a cover for the upper chamber for minimizing the contamination of the environment, by reducing evaporation of the solvent during non-use.

10. The artificial nail remover container device according to claim 1, wherein said solvent is acetone.

11. The artificial nail remover container device according to claim 1, wherein said hot liquid is water at 100° F.

12. The method of removing artificial nails from fingernails comprising:

providing a plastic bath container containing an upper chamber and a lower chamber with at least one basin in the upper chamber with a curvilinear bottom for accepting a solvent;

adding a solvent in the at least one basin;

filling the lower chamber with hot liquid to warm the solvent;

dipping the artificial nails and fingernails in the warmed solvent to dissolve an adhesive bonding the artificial nails to the fingernails; and removing the artificial nails from the fingernails.

13. The method according to claim 12, including the step of rubbing the artificial nails on ridges located on a bottom of the at least one basin containing solvent.

14. The method according to claim 12, including the step of adding marbles to the at least one basin containing solvent.

15. The method according to claim 12, including the step of immersing the artificial nails of both hands in separate basins of the upper chamber containing solvent.

16. The method according to claim 12, including the step of vibrating the solvent during the dipping step.

* * * * *